US011311113B2

(12) United States Patent
Cailley et al.

(10) Patent No.: US 11,311,113 B2
(45) Date of Patent: Apr. 26, 2022

(54) HEIGHT-ADJUSTABLE SUPPLE MEMBER

(71) Applicant: TOURNADRE SA STANDARD GUM, Bourges (FR)

(72) Inventors: Géraud Cailley, Bourges (FR); Pascal Lobry, Bourges (FR); Jacques Lobry, Bourges (FR)

(73) Assignee: TOURNADRE SA STANDARD GUM, Bourges (FR)

( * ) Notice: Subject to any disclaimer, the term of this patent is extended or adjusted under 35 U.S.C. 154(b) by 113 days.

(21) Appl. No.: 16/720,872

(22) Filed: Dec. 19, 2019

(65) Prior Publication Data

US 2020/0205578 A1 Jul. 2, 2020

(30) Foreign Application Priority Data

Dec. 21, 2018 (FR) ..... 1874042

(51) Int. Cl.

| | |
|---|---|
| ***A47C 27/06*** | (2006.01) |
| ***A47C 23/043*** | (2006.01) |
| ***A47C 7/34*** | (2006.01) |
| ***A47C 23/05*** | (2006.01) |

(52) U.S. Cl.

CPC ..... *A47C 23/0435* (2013.01); *A47C 7/345* (2013.01); *A47C 7/347* (2013.01); *A47C 23/05* (2013.01)

(58) Field of Classification Search

CPC ..... A47C 27/06; A47C 27/065; A47C 27/04; A47C 23/04; A47C 23/0438

See application file for complete search history.

(56) References Cited

U.S. PATENT DOCUMENTS

| | | | | |
|---|---|---|---|---|
| 1,020,350 A * | 3/1912 | Hawkes | ..... | A47C 23/0438 5/256 |
| 2,842,784 A * | 7/1958 | Grund | ..... | A47C 27/061 5/697 |
| 4,667,357 A | 5/1987 | Fortune | | |
| 6,477,727 B1 * | 11/2002 | Fromme | ..... | A47C 23/002 267/81 |

(Continued)

FOREIGN PATENT DOCUMENTS

| | | |
|---|---|---|
| DE | 102008050108 A1 | 4/2010 |
| EP | 1155643 A2 | 11/2001 |

(Continued)

*Primary Examiner* — Peter M. Cuomo
*Assistant Examiner* — Ifeolu A Adeboyejo
(74) *Attorney, Agent, or Firm* — The Webb Law Firm

(57) ABSTRACT

The invention relates to a height-adjustable supple member for lying and/or sitting furniture, including one or more adjustable springs and a rotary part. Each adjustable spring is configured to change in height along a central axis under the effect of a radial stress relative to the central axis. The rotary part includes one or more rails each extending over an angular sector about the central axis, in a plane perpendicular to the central axis, from a first end to a second end more distant from the central axis than the first end. Each rail cooperates, in the radial direction relative to the central axis, with a corresponding adjustable spring among the one or more adjustable. The rotary part is able to rotate, about the central axis, so as to exert, through each rail, said radial stress on the corresponding adjustable spring.

12 Claims, 7 Drawing Sheets

(56) References Cited

U.S. PATENT DOCUMENTS

| | | | | |
|---|---|---|---|---|
| 6,487,738 | B1 * | 12/2002 | Graebe | A47C 23/043 267/82 |
| 6,826,791 | B2 | 12/2004 | Fromme | |
| 2009/0014929 | A1 * | 1/2009 | Bock | A47C 23/002 267/103 |
| 2018/0325273 | A1 * | 11/2018 | Cailley | A47C 27/065 |
| 2018/0325275 | A1 * | 11/2018 | Cailley | A47C 27/061 |

FOREIGN PATENT DOCUMENTS

| | | | |
|---|---|---|---|
| EP | 1386564 | A1 | 2/2004 |
| EP | 3400841 | A1 | 11/2018 |
| EP | 3400842 | A1 | 11/2018 |
| WO | 9627312 | A1 | 9/1996 |
| WO | 2008015235 | A1 | 2/2008 |

* cited by examiner

[Fig. 1A]
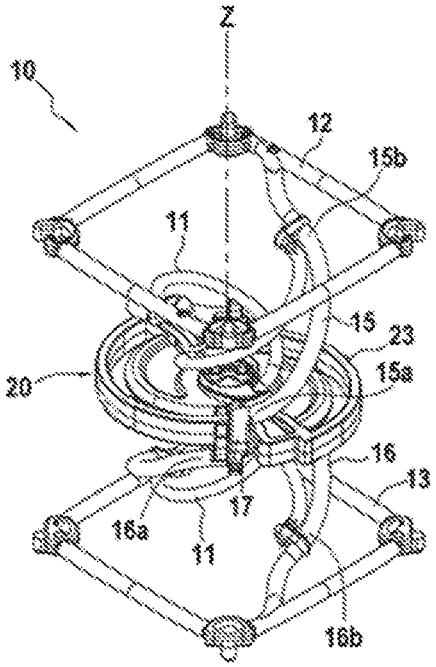
[Fig. 1B]
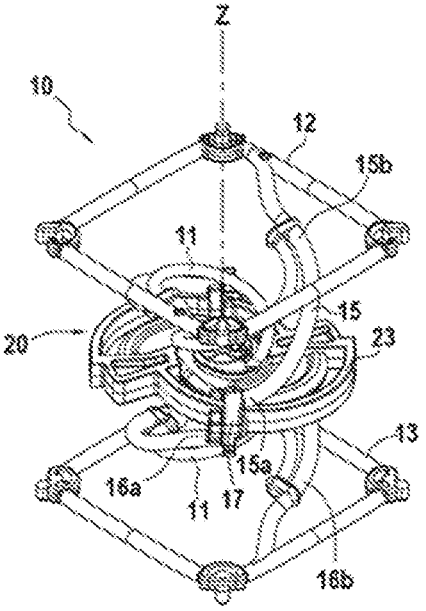

[Fig. 1C]
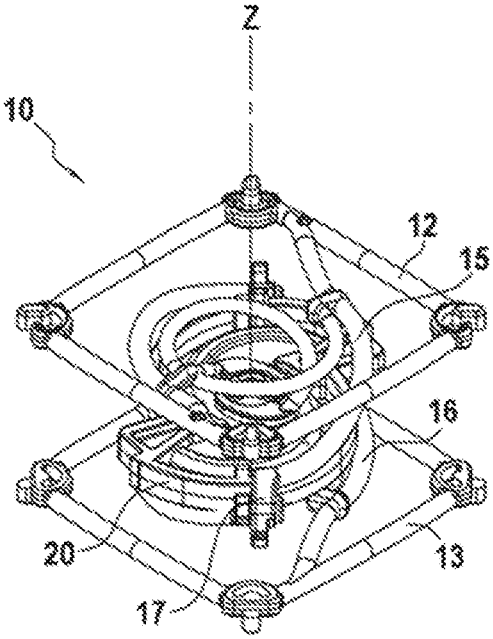
[Fig. 2A]
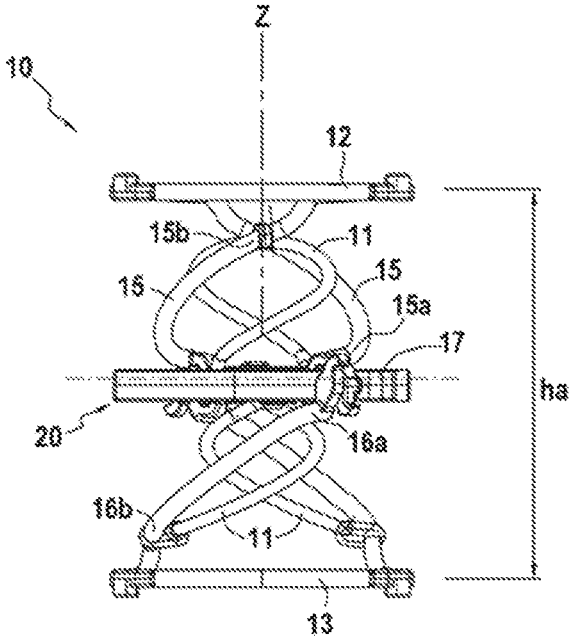

[Fig. 2B]
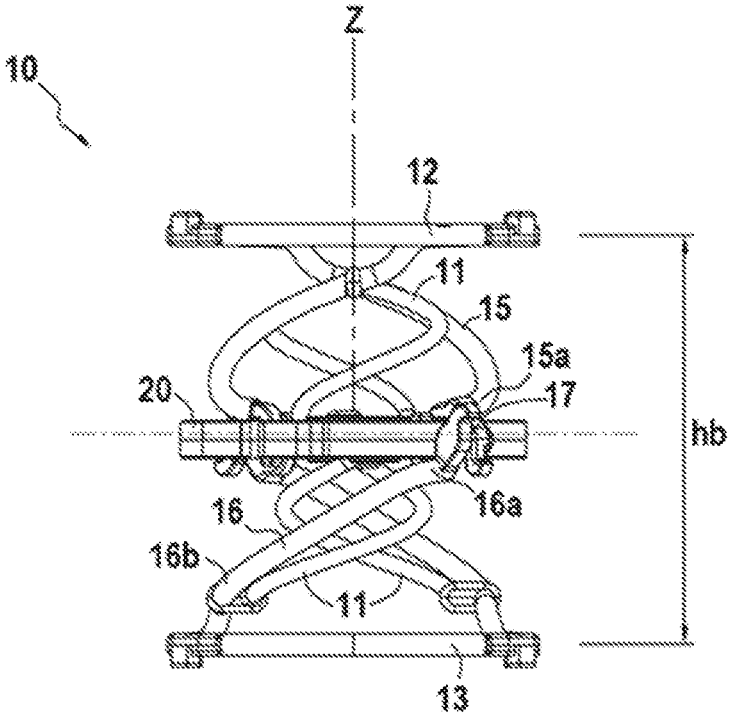
[Fig. 2C]
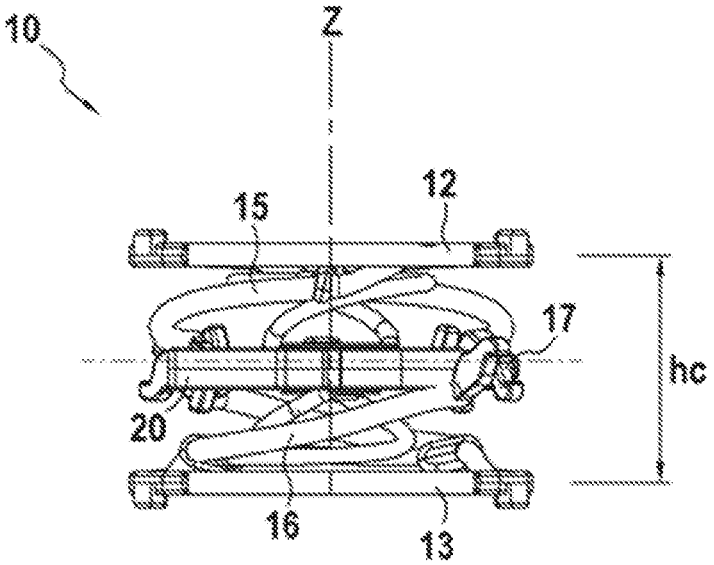

[Fig. 3A]
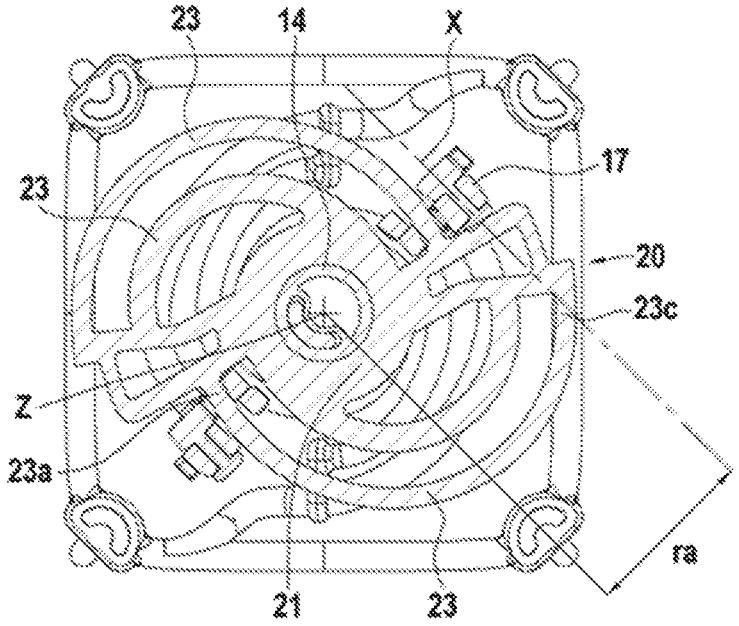
[Fig. 3B]
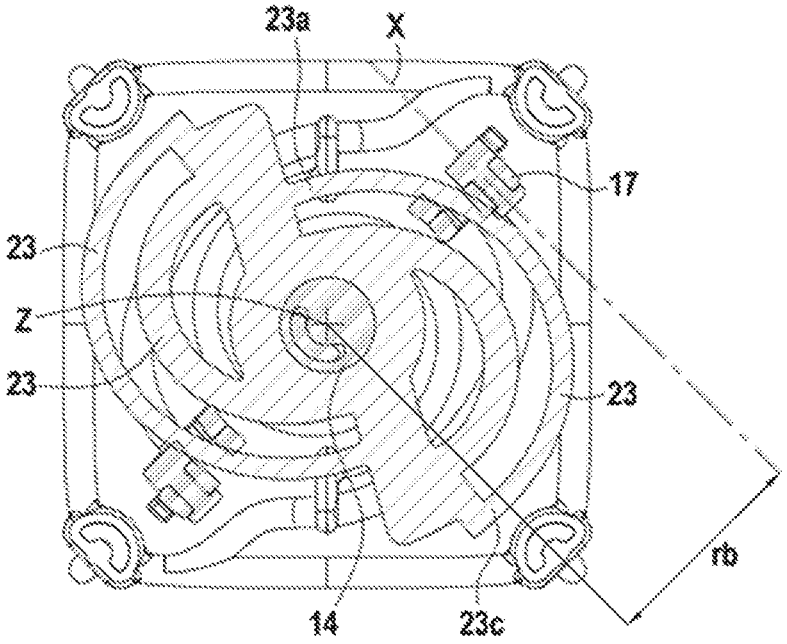

[Fig. 3C]
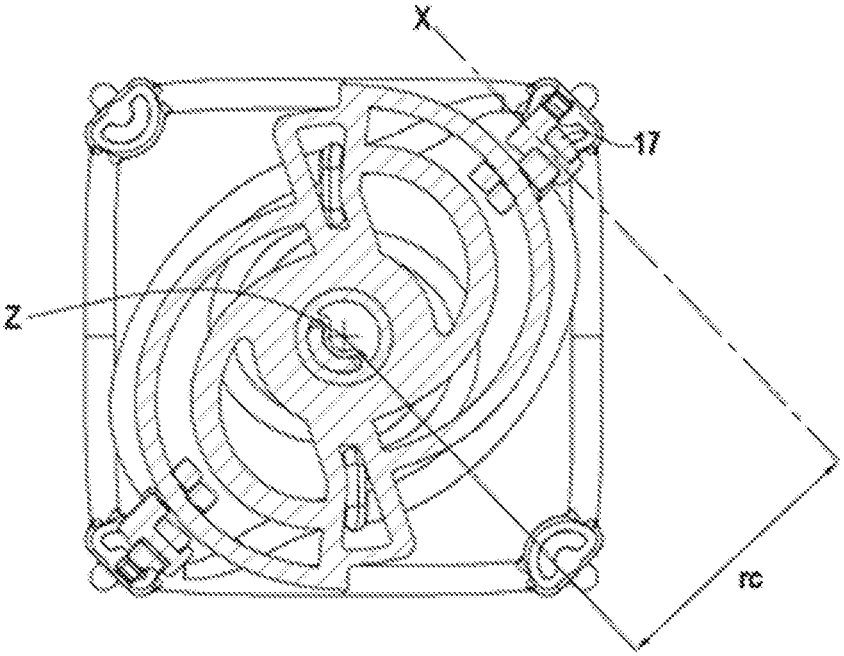
[Fig. 4]
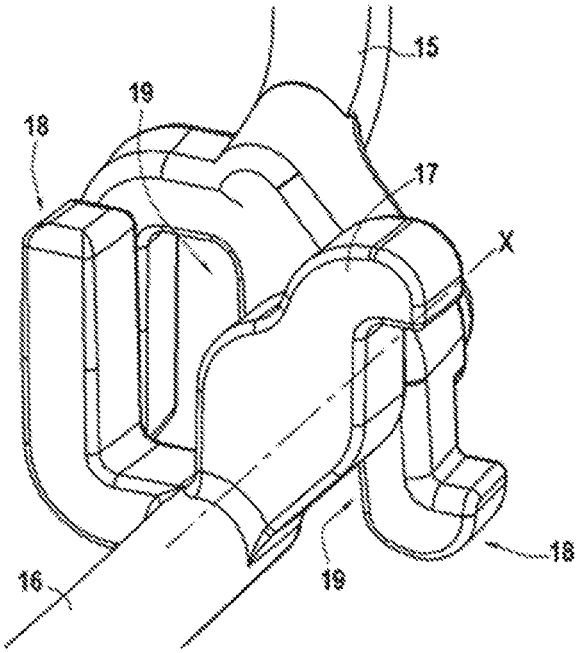

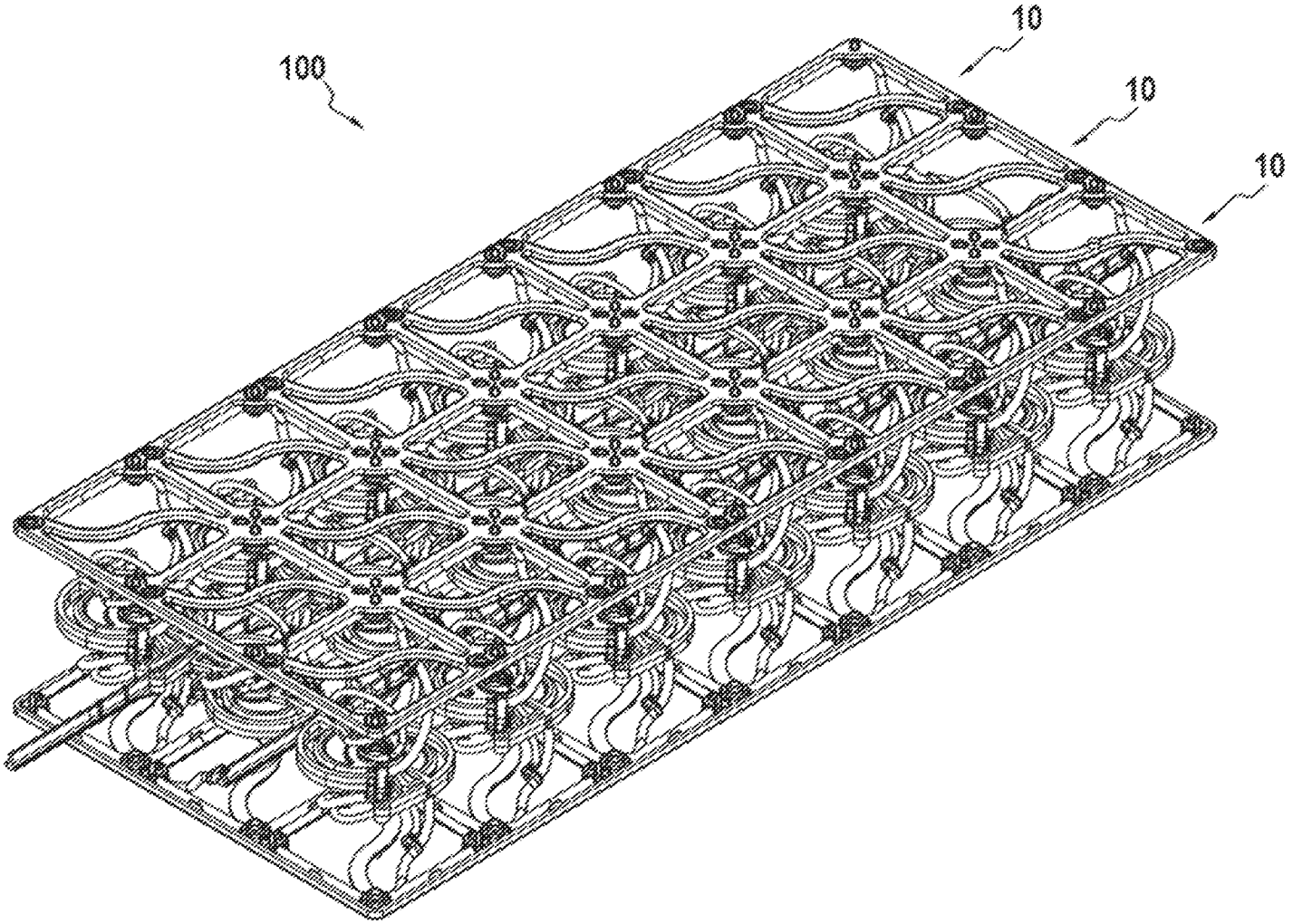
[Fig. 5]

[Fig. 6]
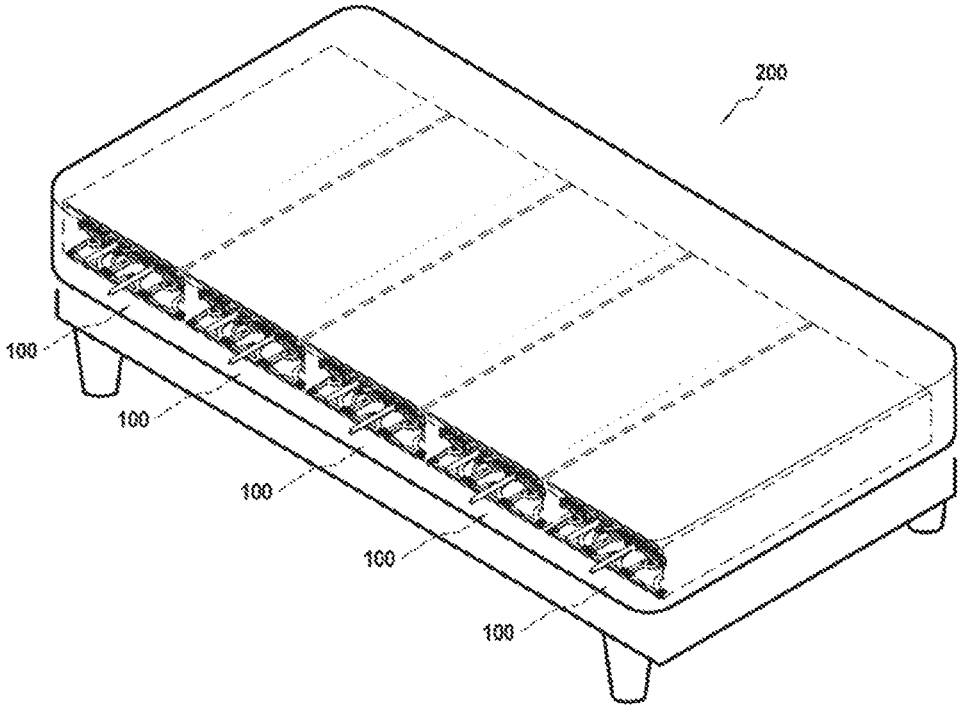
[Fig. 7]
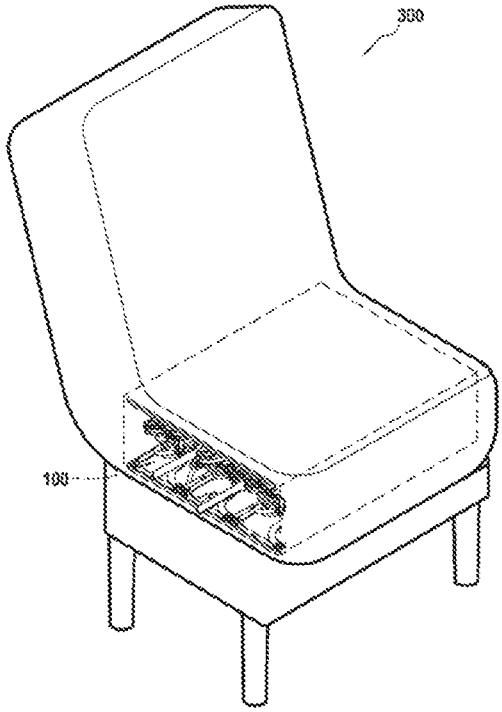

HEIGHT-ADJUSTABLE SUPPLE MEMBER

CROSS-REFERENCE TO RELATED APPLICATION

This application claims priority to French Patent Application No. 1874042 filed Dec. 21, 2018, the disclosure of which is hereby incorporated by reference in its entirety.

TECHNICAL FIELD

The present disclosure relates to the furnishing field and more particularly to a height-adjustable supple member for lying and/or sitting furniture. It is meant by "lying and/or sitting furniture" not only furniture intended for domestic use or in collective facilities but also, for example, seats, beds, berths and/or stretchers intended for transportation means.

PRIOR ART

In order to make a sitting, backrest or lying surface adaptable to the preferences and anatomy of different users, assemblies, such as mattresses or bed bases, having supple members with adjustable stiffness have been previously disclosed, for example, in documents EP 1 386 564 A1, EP 1 155 643 A2, WO 2008/015235, WO 96/27312, U.S. Pat. No. 4,667,357 or DE 2008 050 108 A1. Typically, the stiffness of the members is adjusted with restrictions to their mechanical deformation. For this, however, the proposed mechanisms have a significant complexity and/or space requirement.

SUMMARY OF THE INVENTION

The present disclosure aims at overcoming the aforementioned drawbacks, by proposing a height-adjustable supple member for lying and/or sitting furniture, with a simple structure and limited space requirement.

To achieve this purpose, according to a first aspect of this disclosure, the supple member may comprise one or more adjustable springs, each configured to change in height along a central axis under the effect of a radial stress relative to the central axis, and a rotary part including one or more rails each extending over an angular sector about the central axis, in a plane perpendicular to the central axis, from a first end to a second end more distant from the central axis than the first end, each rail cooperating, in the radial direction relative to the central axis, with a corresponding adjustable spring among the one or more adjustable springs, and the rotary part being able to rotate, about the central axis, so as to exert, through each rail, said radial stress on the corresponding adjustable spring, to vary the height of the adjustable springs. Each adjustable spring can in particular be a helical spring, although other shapes can also be envisaged.

Thanks to the shape of the rails and to the configuration of the adjustable springs, it is possible to vary their height along the central axis, and therefore also their stiffness, by rotation of the rotary part about the central axis.

The adjustable springs may comprise one or more pairs of adjustable springs, each pair of adjustable springs comprising an upper adjustable spring and a lower adjustable spring whose ends are connected by a corresponding hinge with a pivot axis orthogonal to the central axis. Particularly, each rail can pass through a space defined by a pair of jaws associated with the corresponding hinge. The upper and lower adjustable springs can thus be arranged in series and be adjustable together.

The supple member may further include one or more coaxial inner springs of the adjustable springs. The inner springs may be helical, comprising at least two springs disposed in series and/or at least two springs disposed in parallel. However, other arrangements and/or alternative shapes can also be envisaged.

The rotary part may in particular comprise a hub rotatably supported about the central axis by a central body secured to the inner springs, the rails being secured to the hub.

A second aspect of the present disclosure relates to an assembly comprising a plurality of height-adjustable supple members, such as the aforementioned supple member, oriented in parallel. Such an assembly can therefore provide a bearing surface whose thickness and firmness will be adjustable through the height and stiffness of the supple members. It can be envisaged that the rotary parts of the supple members of this assembly are coupled in rotation, so as to allow the simultaneous adjustment of the height of several supple members of the assembly.

A third aspect of the present disclosure relates to a lying or sitting furniture comprising one or more assemblies such as the abovementioned assembly. These assemblies can be integrated, for example, into a mattress, bed base and/or cushion forming part of the furniture.

A fourth aspect of the present disclosure relates to a method for using a height-adjustable supple member such as the abovementioned member, comprising at least one step of rotating the rotary part between the blocked and unblocked positions to adjust the stiffness of the height-adjustable supple member.

The invention will be better understood and its advantages will become more apparent upon reading the following detailed description of one embodiment represented by way of nonlimiting example. The description refers to the appended drawings in which:

BRIEF DESCRIPTION OF THE DRAWINGS

FIG. 1A is a perspective view of a supple member according to one embodiment, with a rotary part in an extended position.

FIG. 1B is a perspective view of the supple member of FIG. 1A, with the rotary part in an intermediate position.

FIG. 1C is a perspective view of the supple member of FIGS. 1A and 1B, with the rotary part in a contracted position.

FIG. 2A is a side view of the supple member of FIGS. 1A to 1C, with the rotary part in the extended position.

FIG. 2B is a side view of the supple member of the preceding figures, with the rotary part in the intermediate position.

FIG. 2C is a side view of the supple member of the preceding figures, with the rotary part in the contracted position.

FIG. 3A is a sectional view, in a plane perpendicular to a central axis, of the supple member of the preceding figures, with the rotary part in the extended position.

FIG. 3B is a sectional view, in a plane perpendicular to a central axis, of the supple member of the preceding figures, with the rotary part in the intermediate position.

FIG. 3C is a sectional view, in a plane perpendicular to a central axis, of the supple member of the preceding figures, with the rotary part in the contracted position.

FIG. 4 is a detailed view of a hinge of the supple member of the preceding figures.

FIG. 5 is a perspective view of an assembly of several supple members similar to that of the preceding figures.

FIG. 6 is a schematic view of a bed incorporating assemblies similar to that of FIG. 5.

FIG. 7 is a schematic view of a sofa incorporating an assembly similar to that of FIG. 5.

DESCRIPTION OF THE EMBODIMENTS

A supple member 10 for sitting or lying furniture such as, for example, beds, settees, bedsettees, sofas, etc., and whose compression stiffness along a central axis Z is adjustable, is illustrated in FIGS. 1A to 3C. This supple member 10 may comprise several springs oriented along this central axis Z. Thus, the supple member 10 may comprise one or more inner springs 11. As illustrated in FIGS. 1A to 3C, these inner springs 11 can in particular be helical springs arranged in pairs, each pair of inner springs 11 comprising two springs arranged in parallel, and the pairs being arranged in series between an upper support 12 and a lower support 13 at the ends of the supple member 10 along the central axis Z, and connected by a central body 14. However, the inner springs could possibly be different in number, be differently arranged or even take an entirely different shape, such as foam springs.

The supple member 10 may further comprise one or more adjustable springs. These adjustable springs can also be helical springs, disposed coaxial with the inner springs 11 radially thereoutside relative to the central axis X. Although, in the example illustrated in FIGS. 1A to 3B, the supple member 10 includes two pairs of adjustable springs, a different number of adjustable springs, equal to or greater than one, can also be envisaged. As illustrated, the adjustable springs can in particular be arranged in pairs, and each pair may comprise an upper adjustable spring 15 and a lower adjustable spring 16, connected together, at ends 15*a*, 16*a*, by a corresponding hinge 17 with a pivot axis X orthogonal to the central axis Z and radially offset relative thereto. Opposite ends 15*b* and 16*b* of the upper 15 and lower 16 adjustable springs may be secured to the upper support 12 and to the lower support 13 of the supple member 10, respectively.

In addition, the supple member 10 may comprise a rotary part 20 able to rotate about the central axis Z. As illustrated in FIGS. 1A to 3B, this rotary part 20 may comprise a hub 21 engaged around the central body 14 so as to be able to rotate about the central axis Z relative to this central body 14, while restricting their relative movement in the direction of the central axis Z. In addition, the rotary part 20 may comprise one or more rails 23, secured to the hub 21, each extending between two opposite ends 23*a*, 23*b*, in a plane perpendicular to the central axis Z, on an angular sector about the central axis Z. The radial distance of each rail 23 to the central axis Z may gradually vary from a first end 23*a* closer to the central axis Z, to a second end 23*c* more distant from the central axis Z. Moreover, the rotary part 20 may comprise connections for its actuation in rotation.

As illustrated in detail in FIG. 4, each corresponding hinge 17 may comprise one or more pairs of jaws 18, each pair of jaws 18 defining a space 19 receiving one of the rails 23. As illustrated, this space 19 defined by the jaws 18 can be closed all around the rail 23.

In operation, the rotary part 20 can thus rotate between an extended, or first rotational, position, illustrated in FIGS. 1A, 2A and 3A, and a contracted, or second rotational, position, illustrated in FIGS. 1C, 2C and 3C. In the extended position, the corresponding hinges 17 can be retained by the ends 23*a* of the rails 23 with their pivot axes X at a minimum radial distance ra from the central axis Z, while in the contracted position, the corresponding hinges 17 can be retained by the ends 23*c* of the rails 23 with their pivot axes at a maximum radial distance rc from the central axis Z. The radial distance of each rail 23 relative to the central axis Z can gradually vary between its first and second ends 23*a*, 23*c*, it is thus also possible to gradually vary the radial distance of the corresponding hinges 17 relative to the central axis Z by rotation of the rotary part 20 between its extended and contracted positions, by passing through intermediate positions, such as the one illustrated in FIGS. 1B, 2B and 3B, with the pivot axes X of the hinges 17 at an intermediate radial distance rb from the central axis Z. Overall, in a first rotational position of the rotary part 20 the first end 23*a* of the rail 23 retains the springs 15, 16 at the hinge 17 at a radial distance ra from the central axis Z while in a second rotational position of the rotary part 20 the second end 23*c* of the rail 23 retains the springs 15, 16 at the hinge 17 at a radial distance rc from the central axis Z greater than distance ra.

Through the radial position of the hinges 17, and therefore the corresponding ends 15*a*, 16*a* of the adjustable springs 15, 16, it is possible to vary their pitches and therefore their height in the direction of the central axis Z. Thus, with the rotary part 20 in the extended position illustrated in FIGS. 1A, 2A and 3A, the height of each adjustable spring 15, 16, and therefore also the height of the supple member 10 as a whole, can be maximum, while with the rotary part 20 in the contracted position illustrated in FIGS. 1C, 2C and 3C, the height of each adjustable spring 15, 16, and therefore also the height of the supple member 10 as a whole, can be minimal. Furthermore, the rotation of the rotary part 20 between these two extreme positions can also allow gradually varying the height of the supple member 10 between the maximum height ha of FIG. 2A, and the minimum height hc of FIG. 2C, by passing through the intermediate height hb of FIG. 2B.

Furthermore, varying the height of the supple member 10, by varying its deformation stroke, can also allow varying its compression stiffness along the central axis Z. Thus, the supple member 10 could be substantially stiffer with the intermediate height hb in FIG. 2B than with the maximum height ha in FIG. 2A, and even stiffer with the minimum height hc in FIG. 2C. This stiffness can therefore also be gradually varied by rotation of the rotary part between the extended and contracted positions.

Each of the components of the supple member 10 can be made of organic polymeric material, and produced in particular by injection molding. As illustrated in FIGS. 5 to 7, a plurality of similar supple members 10 can be combined into a single assembly 100 within a lying and/or sitting furniture, such as, for example the bed 200 in FIG. 6 or the sofa 300 in FIG. 7. In this assembly 100, the central axes Z of the supple members 10 can be oriented in parallel, and the rotary parts 20 can be coupled in rotation, for example through the connections 24, so as to allow the simultaneous adjustment of the stiffness of several supple members 10 of the assembly 100. The assembly 100 can be integrated into a mattress, bed base or cushion. It can also be envisaged to integrate several assemblies 100, with adjustable stiffness separately, into a single mattress, bed base or cushion, so as to allow the user to adjust the stiffness in separate areas for better comfort.

Although the present invention has been described with reference to specific examples, it is obvious that various modifications and changes can be made to these examples without departing from the general scope of the invention as defined by the claims. Therefore, the description and the drawings should be considered in an illustrative rather than restrictive sense.

The invention claimed is:

1. A height-adjustable supple member for lying and/or sitting furniture, comprising:

one or more adjustable springs, each configured to change in height along a central axis under the effect of a radial stress relative to the central axis, and a rotary part including one or more rails each extending over an angular sector about the central axis, in a plane perpendicular to the central axis, from a first end to a second end more distant from the central axis than the first end, each rail cooperating, in the radial direction relative to the central axis, with a corresponding adjustable spring among the one or more adjustable springs, and the rotary part being able to rotate, about the central axis, so as to exert, through each rail, said radial stress on the corresponding adjustable spring, to vary the height of the adjustable springs, wherein in a first rotational position of the rotary part the first end of the rail retains the springs at the hinge at a radial distance (ra) from the central axis Z while in a second rotational position of the rotary part the second end of the rail retains the springs at the hinge at a radial distance (rc) from the central axis Z greater than distance (ra).

2. The height-adjustable supple member according to claim 1, wherein each adjustable spring is a helical spring disposed about the central axis.

3. The height-adjustable supple member according to claim 1, wherein the adjustable springs comprise one or more pairs of adjustable springs, each pair of adjustable springs comprising an upper adjustable spring and a lower adjustable spring whose corresponding ends are connected by a hinge with a pivot axis orthogonal to the central axis.

4. The height-adjustable supple member according to claim 3, wherein each rail passes through a space delimited by a pair of jaws associated with the corresponding hinge.

5. The height-adjustable supple member according to claim 1, further including one or more coaxial inner springs of the adjustable springs.

6. The height-adjustable supple member according to claim 5, wherein the inner springs comprise at least two springs disposed in series.

7. The height-adjustable supple member according to claim 5, wherein the inner springs comprise at least two springs disposed in parallel.

8. The height-adjustable supple member according to claim 5, wherein the inner springs are helical.

9. The height-adjustable supple member according to claim 1, wherein the rotary part comprises a hub rotatably supported about the central axis by a central body secured to the inner springs, the rails being secured to the hub.

10. An assembly comprising a plurality of height-adjustable supple members according to claim 1, oriented in parallel.

11. A lying or sitting furniture comprising one or more assemblies according to claim 10.

12. A method for using a height-adjustable supple member according to claim 1, comprising at least one step of rotating the rotary part to adjust the stiffness of the height-adjustable supple member.

* * * * *